US006311499B1

(12) United States Patent
Broadbent

(10) Patent No.: US 6,311,499 B1
(45) Date of Patent: Nov. 6, 2001

(54) DUAL-TEMPERATURE REFRIGERATING DEVICE FOR FREEZING BEVERAGE CONTAINERS

(76) Inventor: John A. Broadbent, 5558 S. Yampa St., Aurora, CO (US) 80015

( * ) Notice: Subject to any disclaimer, the term of this patent is extended or adjusted under 35 U.S.C. 154(b) by 0 days.

(21) Appl. No.: 09/644,502

(22) Filed: Aug. 24, 2000

Related U.S. Application Data

(63) Continuation-in-part of application No. 09/339,713, filed on Jun. 24, 1999, now Pat. No. 6,112,537.

(51) Int. Cl.[7] ..... F25D 3/08
(52) U.S. Cl. ..... 62/66; 62/371; 62/457.4
(58) Field of Search ..... 62/66, 75, 340, 62/371, 457.1, 457.9, 457.4

(56) References Cited

U.S. PATENT DOCUMENTS 4,531,381 * 7/1985 Toro et al. ..... 62/457.4
4,580,412 * 4/1986 Wells ..... 62/457.4
5,440,896 * 8/1995 Maier-Laxhuber et al. ..... 62/457.4
5,845,514 * 12/1998 Clarke et al. ..... 62/457.4
6,067,816 * 5/2000 Hodosh ..... 62/457.4

* cited by examiner

*Primary Examiner*—William E. Tapolcai
(74) *Attorney, Agent, or Firm*—Gibson, Dunn & Crutcher LLP

(57) ABSTRACT

A dual-temperature refrigerating device for partially freezing beverage inside a sealed beverage container. One compartment within the device is held at a temperature below freezing and another compartment is kept at a temperature above freezing. An opening between the two compartments allows a beverage container to be placed so that is simultaneously exposed to below-freezing temperatures above-freezing temperatures. This arrangement causes the beverage in the portion of the container exposed to the below-freezing temperatures to freeze while the beverage in the part of the container exposed to above freezing temperatures does not freeze.

24 Claims, 3 Drawing Sheets

DUAL-TEMPERATURE REFRIGERATING DEVICE FOR FREEZING BEVERAGE CONTAINERS

This patent application is a continuation-in-part of pending U.S. patent application Ser. No. 09/339,713, filed Jun. 24, 1999, now U.S. Pat. No. 6,112,537, the contents of which are incorporated by reference.

FIELD OF THE INVENTION

The present invention relates to the field of refrigeration equipment. Specifically, the present invention relates to refrigeration equipment designed to hold beverage containers and to simultaneously provide two temperatures for those containers: a sub-freezing temperature for a portion of the container and an above-freezing temperature for a portion of the container. Such refrigerating equipment allows a portion of the beverage in the container to be frozen while the majority of the beverage remains unfrozen. When removed from refrigeration, the frozen beverage in the container keeps the unfrozen beverage cool.

BACKGROUND OF THE INVENTION AND RELATED ART

Application Ser. No. 09/339,713 describes a container having one end specifically designed to hold frozen beverage while the rest of the container would hold unfrozen beverage. Such a container has the desirable characteristic that the frozen beverage will keep the unfrozen beverage cool for an extended period of time. The patent application also described special dual-temperature refrigeration equipment that would be used to freeze such a container. Such refrigeration equipment is described in more detail herein. In order to freeze a portion of a beverage within a container, it is necessary to provide an environment for a portion of the container that is below the freezing temperature of the beverage. To simultaneously keep the rest of the beverage unfrozen, the rest of the container must be exposed to an environment that is above the freezing temperature of the beverage.

Equipment for providing such dual-temperature environments can come in many varieties. For example, the simplest version is a heated enclosure within a freezer. The heated enclosure surrounds the majority of the beverage container, but a portion of the container protrudes out of the heated enclosure into the sub-freezing environment of the freezer. Thus the portion of the container within the heated enclosure is maintained at above-freezing temperatures, while the portion of the container protruding out of the enclosure sees the sub-freezing temperatures needed to freeze a portion of the beverage. Other types of dual-temperature refrigerated equipment include: walk-in coolers, freezers, and display cases, reach-in coolers, freezers, and display cases, vending machines, transport refrigeration and domestic refrigerator/freezers.

Refrigeration equipment that simultaneously provides two different temperatures, one above freezing and one below freezing, are extremely common and well known. For example, the typical domestic refrigerator/freezer provides freezing temperatures for frozen goods in one compartment while simultaneously providing above-freezing temperatures for beverages and other non-frozen perishables in an adjacent compartment. Likewise, refrigeration equipment in grocery and convenience stores for frozen goods and for refrigerated (non-frozen) goods is often found side-by-side, and may be part of a common refrigeration system.

However, such equipment does not provide an opening between the two compartments necessary to expose a single container to both compartments at the same time so that a portion of the container's contents can be frozen while the rest is maintained unfrozen.

The primary objective of this invention is to provide a dual-temperature environment for one or more containers so that a portion of the contents of the container(s) is caused to freeze while the rest of the contents remain unfrozen.

Another primary objective of this invention is to provide a dual-temperature refrigeration device that is suitable for use in grocery, convenience store and other retail locations.

Another primary objective of this invention is to provide a dual-temperature environment within a beverage-container vending machine.

Another primary objective of this invention is to provide such a dual-temperature refrigeration device that can be used to freeze or keep frozen beverage containers while they are being transported.

Another primary objective of this invention is to provide a dual-temperature environment within a domestic refrigerator/freezer.

It should be understood that nothing stated herein, including without limitation reference to my previous application, is admitted to be "prior art" but is instead described to help place the present invention in context.

SUMMARY OF THE INVENTION

As used herein, the term "beverage" shall not be limited to liquids for drinking, but shall include any fluid, including water. Likewise the terms "water" and "ice" are used for convenience herein to refer to the liquid and solid phases of any beverage, and "freezing" and "32° F." are used to refer to the liquid-solid phase change temperature for such a beverage in whatever ambient conditions a device or method according the present invention is employed. The term "container" shall include bottles, cans, cartons and other types of containers.

The present invention provides a dual-temperature environment for one or more beverage containers so that a portion of the beverage within each container may be frozen while the remaining contents of each container will remain unfrozen. The device can take many forms, depending on its intended use. The container with which the invention is used may or may not be specially configured for this purpose.

All of the various forms of this invention contain three main parts: 1.) a compartment or zone held at a temperature above the freezing temperature of the beverage in the container(s), 2.) a compartment or zone held at a temperature below the freezing temperature of the beverage in the container(s), 3.) aperture(s) or opening(s) between the two compartments in which the beverage containers will be located. By placing a container in the aperture so that a portion of the container is located within the "cold" compartment or zone and a portion is located in the "warm" compartment or zone, it is possible to freeze a portion of the beverage while keeping the rest unfrozen. The refrigerated device may also include some sealing device (e.g., a gasket) at the aperture to seal around the container and thus minimize unwanted heat transfer between the two compartments. Another sealing device (e.g., a door or curtain) may also be used to close the aperture when a container is not present.

There are four basic forms that this invention may take. Those four forms are: 1.) a heated compartment within a freezer, 2.) a freezer compartment within a refrigerator or cooler, 3.) two side-by-side compartments, one cold and one warm, and 4.) a freezer configured to use the surrounding ambient air temperatures as the "warm" zone. Each of these four forms also includes apertures or openings so that a beverage container can be located simultaneously in both the cold and warm parts of the device. An example of the first form is a heated, insulated box located inside a freezer. Heat for the device is provided, for example, by an electrical resistance heater, a lamp, a fan, or from heat leakage (or air infiltration) from the environment outside of the freezer.

An example of the second form of the invention is an enclosure within a refrigerator, the enclosure having a separate source of refrigeration that allows it to be at temperatures below freezing. This second source of refrigeration is, for example, a totally separate refrigeration system, or a low-temperature segment of the main refrigeration system, or it is achieved by piping-in cold air from an existing, nearby freezer.

An example of the third form of the invention is a refrigerator/freezer with an opening between the refrigerator and freezer compartments. Placing a container in the opening allows the container to be simultaneously exposed to the two temperature environments to achieve the desired freezing.

An example of the fourth form of the invention is a freezer having openings in it into which beverage containers are inserted. The containers are inserted so that part of the container sits inside the freezer, and part protrudes outside the freezer. The cold temperatures inside the freezer cause part of the beverage to freeze, while the warmth existing outside the freezer keeps the rest of the beverage unfrozen.

It is anticipated that this invention will be applied in a number of different applications. These applications may include one or more of the following:

Walk-in coolers or refrigerators
Walk-in freezers
Reach-in refrigerators and/or display cases
Reach-in freezers or display cases
Refrigerated merchandisers
Vending machines
Domestic refrigerator/freezers
Transport refrigeration
Heated enclosures for use within freezers The freezing of the beverage in the containers may be optimized by the design of the container itself and/or the control of the temperatures in the two compartments. For example, by configuring a beverage container so as to minimize the heat transfer between the portion of the container to be frozen and the portion to be kept unfrozen, it is possible to: a.) speed-up the freezing, b.) achieve freezing with a smaller temperature difference, c.) more accurately control the location and amount of beverage which is frozen, and d.) make the position of the liquid-solid (or beverage-ice) boundary less sensitive to the temperatures inside the two compartments.

The temperatures normally used to maintain the desired amount of frozen beverage in the container do not result in the fastest possible initial freezing of the beverage. By temporarily lowering the temperature in either or both of the two compartments, it is possible to more quickly freeze the beverage in the container. However, this lower temperature will, if maintained too long, result in the entire container becoming frozen. By lowering the temperature(s) temporarily when the unfrozen containers are initially placed into the device, faster freezing can be achieved without over-freezing the container.

BRIEF DESCRIPTION OF THE DRAWINGS

A better understanding of the invention can be had by reference to the following Detailed Description in conjunction with the accompanying Drawings, wherein.

Figure 1:
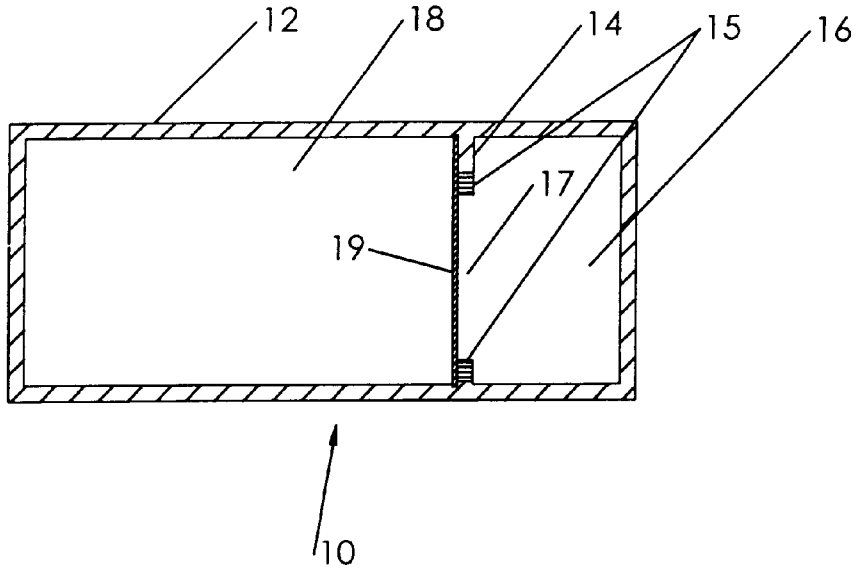
FIG. 1 is a vertical cross-section a simplified version of a dual-temperature refrigerating device, not yet containing a beverage container.

| Reference Numerals in Drawings | |
|---|---|
| Enclosure | 10 |
| Insulating walls | 12 |
| Dividing wall | 14 |
| Sealing means | 15 |
| Cold compartment | 16 |
| Aperture | 17 |
| Warm compartment | 18 |
| Door | 19 |
| Beverage container | 20 |
| Cap | 22 |
| Internal barrier | 24 |
| Beverage compartment | 26 |
| Ice compartment | 28 |
| Liquid beverage | 30 |
| Frozen beverage | 32 |
| Air gap | 34 |
| Heated enclosure | 40 |
| Freezer | 42 |
| Heat source | 44 |
| Fan | 46 |
| Fan | 48 |
| Thermostat | 50 |
| Common wall | 52 |
| Freezer | 60 |
| Refrigerator | 62 |
| Cooling means | 64 |
| Fan | 66 |
| Fan | 68 |
| Thermostat | 69 |
| Refrigerator/freezer | 70 |
| Refrigerated space | 72 |
| Freezer space | 74 |
| Cooling means | 76 |
| Cooling means | 78 |
| Heat source | 80 |
| Thermostat | 82 |

-continued

| Reference Numerals in Drawings | |
|---|---|
| Thermostat | 84 |
| Fans | 86 |
| Freezer | 90 |
| Cooling means | 92 |
| Thermostat | 94 |
| Fan | 96 |

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims. For example, the drawings herein of various dual-temperature refrigerating devices have been simplified to all show only a single beverage container housed within it. It is likely that most such devices would in fact hold multiple beverage containers. Thus, all claims referring to a "container" will be construed to cover a device or method employing one and/or more than one container.

Generic Dual-Temperature Refrigerating Device

Referring to FIG. 1, a vertical cross-section of a simplified refrigerated enclosure 10 is shown. Enclosure 10 is used to hold a beverage container and keep the beverage inside it partially frozen. Enclosure 10 consists of insulating walls 12, a dividing wall 14 to separate the cold compartment 16 from the warm compartment 18, and an aperture or opening 17 in which a beverage container is placed. An optional sealing means 15, a gasket for example, around aperture 17 is used to help seal any gaps between wall 14 and the beverage container. Ideally, there is also a door or other closure means 19 used to close aperture 17 if no container is present in enclosure 10. The purpose of enclosure 10 is to maintain the temperature of the cold compartment 16 below the freezing temperature of the beverage while simultaneously maintaining the temperature of the warm compartment 18 above the freezing temperature of the beverage.

Figure 2:
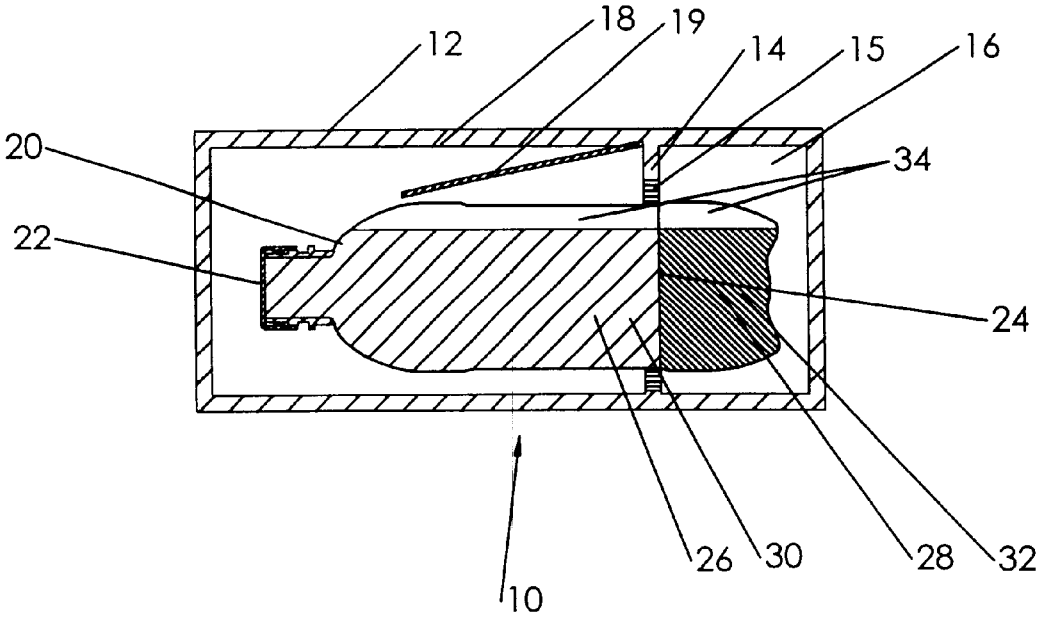
FIG. 2 is a vertical cross-section a simplified version of a dual-temperature refrigerating device containing a beverage container.

FIG. 2 again shows a vertical cross-section of a simplified refrigerated enclosure 10, this time with a beverage container 20 inside it. Door 19 is raised up, allowing container 20 to be placed through aperture 17. Beverage container 20 has a cap 22 and an internal barrier 24. Barrier 24 separates container 20 into two compartments: a beverage compartment 26 and an ice (or frozen beverage) compartment 28. Barrier 24 also affects the heat transfer within container 20 in a way that promotes freezing within the ice compartment 28. Both compartments are filled with beverage, but the beverage compartment 26 is filled with liquid (unfrozen) beverage 30 while the ice compartment 28 is shown filled with frozen beverage 32. Maintaining the proper temperatures in warm compartment 18 and cold compartment 16 allows the beverage 30 to freeze and stay frozen in ice compartment 28 as it is shown in FIG. 2. Experimental tests have shown that, for example, maintaining the temperature of the cold compartment 16 at approximately 15° F. while keeping the warm compartment 18 at approximately 40° F. causes the desired freezing when the beverage is water.

FIG. 2 shows container 20 oriented in a horizontal position; that is, the enclosure 10 and container 20 cooperate so that the compartments 26 and 28 are positioned at generally the same height While other orientations also allow the beverage 30 in beverage compartment 26 to be frozen, a horizontal orientation works well when the container has a barrier 24 within it. Experiments have shown that a horizontal position encourages convection currents within the beverage compartment 26 that result in a sharp liquid-ice interface at the barrier 24. In contrast, if the container is frozen in an upright vertical orientation, the heat transfer within the container 20 is predominantly conductive, and the resulting liquid-ice boundary location is controlled only by the temperatures in the warm compartment 18 and the cold compartment 16. Because of this, properly freezing a vertically oriented container requires very precise temperature control. The location of the ice boundary when frozen in the horizontal orientation is much less temperature-sensitive. When there is no barrier 24 inside container 20, the orientation of the container is less important.

Also shown in FIG. 2 is an air gap 34 existing both in the ice compartment 28 and the beverage compartment 26. It is important that some air gap 34 exist within beverage compartment 26 during freezing. If all the air in the container were instead to be inside the ice compartment 28 during freezing, an air pocket would be frozen into ice compartment 28 and there would be no air inside the beverage compartment 26. The resulting container would appear as though it had been filled completely to the brim before being capped. When opened, such a container will cause beverage to shoot out the top in a very undesirable way. Leaving some air in the beverage compartment 26 during freezing prevents this.

Heated Enclosure Within A Freezer

Figure 3:
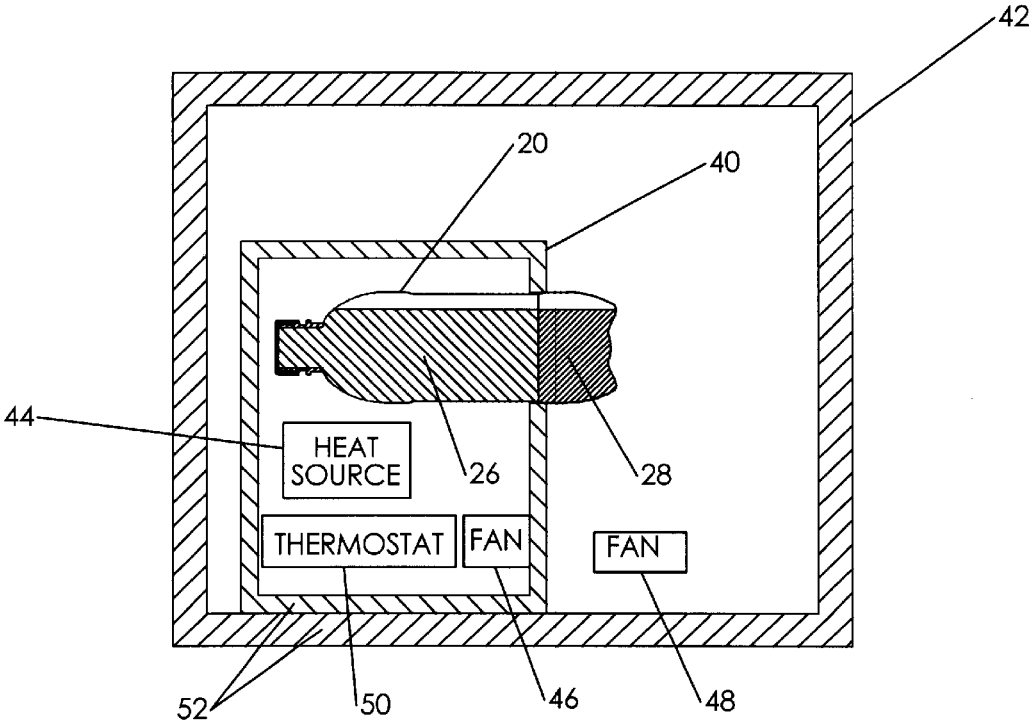
FIG. 3 is a vertical cross-section a version of a dual-temperature refrigerating device created by locating a heated, insulated box inside a freezer. A beverage container is located within the device.

FIG. 3 illustrates the present invention configured as a heated and insulated enclosure 40 inside a freezer 42 (or other sub-freezing environment). Beverage container 20 is positioned inside heated enclosure 40 such that the beverage compartment 26 portion of container 20 is inside enclosure 40 while the ice compartment 28 protrudes out of enclosure 40 and into the sub-freezing environment inside freezer 42. This configuration provides the necessary thermal environment to properly freeze the beverage in the ice compartment 28 while keeping unfrozen the beverage in the beverage compartment 26.

Also shown in FIG. 3 are a heat source 44, a fan 46 inside enclosure 40 and a fan 48 inside the freezer 42. Heat source 44 is required to maintain the inside of enclosure 40 at a temperature above freezing. Fans 46 and 48 are optional, but are helpful in maintaining uniform temperatures throughout enclosure 40 and freezer 42 and to improve the heat transfer between the walls of the container 20 and the surrounding air.

Heat source 44 is an electrical resistance heater, a light bulb, or any other suitable source of heat. Heat source 44 could be the heat generated by fan 46, provided it generates sufficient heat. Heat source 44 can even be warmer air brought in from outside the freezer or even simply the "heat leakage" that passes through the walls of the freezer 42 and the walls of enclosure 40 through a common wall 52. Heat source 44 is preferably controlled by a thermostat 50 so that the temperature within enclosure 40 is maintained at a desired setting. Freezer 42, being a conventional freezer, is also controlled so that its internal temperature is maintained at a somewhat steady, sub-freezing temperature.

The heated enclosure 40 can be a very low cost device that can be inserted into (or removed from) any freezer; for example a standard household freezer. By making the enclosure 40 out of an insulated fabric sleeve or an insulated box into which a container can be partially inserted, and by placing a small electrical resistance heater inside the sleeve (for example a 7.5-watt night-light bulb), a very low-cost dual-temperature refrigeration device can be created. No thermostat or fan is required. Simply by placing a beverage container 20 within this heated enclosure 40 and then placing that inside a freezer 42, one now has a functioning dual-temperature refrigeration device capable of freezing the beverage 30 in the beverage container 20 in the desired way.

FIG. 3 also shows container 20 positioned in a horizontal orientation. It is possible to achieve the desired freezing with container 20 in other orientations. For example, it is possible to orient container 20 vertically (right-side-up). When freezing in a vertical orientation with a container 20 having a barrier 24, best results are achieved by locating the heat source 44 near the base of the beverage compartment 26, thereby inducing convection currents within the beverage compartment 26. The convection currents tend to keep the ice-beverage interface in the desired location, i.e., at the barrier 24. Providing even heating around the beverage compartment 26 or by providing more heat near the top of the beverage compartment 26 do not create these convection currents, and make it much more difficult to control the position of the ice-beverage interface.

Freezer Enclosed Within A Refrigerator

Figure 4:
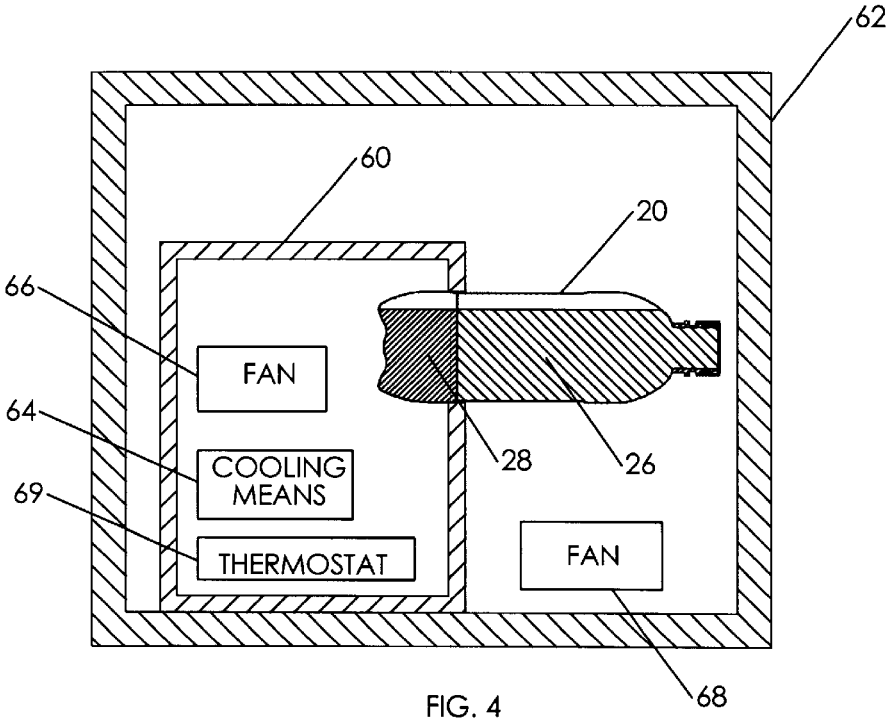
FIG. 4 is a vertical cross-section a version of a dual-temperature refrigerating device created by locating a freezer within a refrigerator. A beverage container is located within the device.

FIG. 4 illustrates essentially the reverse of the configuration shown in FIG. 3. That is, rather than having a heated enclosure inside a freezer, FIG. 4 illustrates a freezer 60 enclosed within a warmer refrigerator 62. Once again a container 20 is placed such that its ice compartment 28 is exposed to the sub-freezing temperatures within freezer 60 while its beverage compartment 26 is exposed to the warmer temperatures inside the refrigerator 62. Cooling for freezer 60 is provided by a cooling means 64 that can be: a.) an additional refrigeration system separate for the refrigeration system for refrigerator 62, b.) a low-temperature segment of the refrigeration system for refrigerator 62, or c.) some other source of cooling external to the refrigerator (cold air piped-in from a nearby freezer, for example). Also shown in FIG. 4 are optional fans 66 and 68 that are used to help keep the temperatures uniform, and an optional thermostat 69 that is used to control the temperature inside freezer 60. Refrigerator 62 is a conventional refrigerator having controls to maintain its internal temperature. Like the previously described configuration, the configuration shown in FIG. 4 is able to freeze the beverage in ice compartment 28 while keeping the beverage in the beverage compartment 26 unfrozen.

A freezer within a refrigerator is useful for situations, for example, where there is an existing refrigerator (e.g., a walk-in or reach-in cooler) used to hold conventional, unfrozen beverages which is desired to be converted to also hold partially frozen beverages. By installing a separate freezer device inside the existing refrigerator, the conversion to a dual-temperature refrigeration device can be made quickly and easily.

Side-By-Side Refrigerator And Freezer

Figure 5:
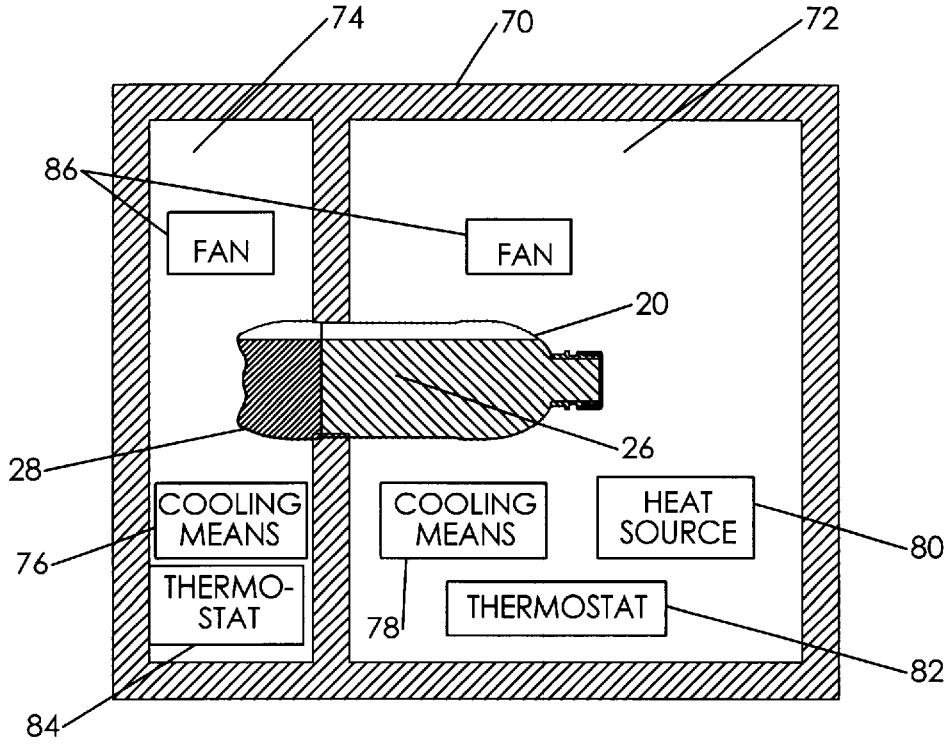
FIG. 5 is a vertical cross-section a version of a dual-temperature refrigerating device wherein a freezer is located side-by-side with a refrigerator. A beverage container is located within the device and situated so that it is partially exposed to the environment within the freezer and partially exposed to the environment within the refrigerator.

FIG. 5 illustrates the configuration where the cold and warm compartments are side-by-side, rather than one inside the other. For applications where a complete stand-alone freezer is built to freeze beverage containers, this is most logical arrangement. In contrast, the configurations previously described above (i.e., a freezer inside a refrigerator or visa-versa) are best used when trying to add a dual-temperature refrigeration to either an existing freezer or an existing refrigerator.

FIG. 5 shows a refrigerator/freezer 70 having a refrigerated space 72 held at a temperature above freezing and a freezer space 74 held at a temperature below freezing. A container 20 is shown positioned within refrigerator/freezer 70 so that the ice compartment 28 of container 20 is inside freezer space 74 and the beverage compartment 26 is located within the refrigerated space 72.

Cooling for freezer space 74 is provided by cooling means 76 that is typically a refrigeration system, but could also be some other source of cooling. Cooling for refrigerated space 72 is provided by cooling mean 78, which is typically part of cooling means 76. However, refrigerator/freezer 70 can be designed such that the cooling of refrigerated space 72 results simply from passive heat transfer between space 72 and space 74, without any additional refrigeration equipment. If space 72 does not have its own cooling means 78, a heat source 80 is used to control the temperature within the space 72. In either case, a thermostat 82 is preferred to control the operation of either or both of the heat source 80 and/or cooling means 78 so as to control the temperature within space 72. A thermostat 84 is used within space 74 to control the temperature within that space. Both spaces 72 and 74 can use fans 86 to keep the temperatures within the spaces uniform and to improve heat transfer to the container 20.

Vending Machine

A vending machine using a dual-temperature refrigerated environment, similar to that shown in FIG. 5, allows partially frozen beverage containers to be dispensed. That is, the vending machine has within it a refrigerated space 72 and a freezer space 74 and the beverage containers 20 are held such that they are simultaneously exposed to both of those spaces. This arrangement allows the beverage containers 20 to be partially frozen and, when such containers 20 are dispensed to a consumer, provide that consumer with a beverage that stays cold longer than a standard, beverage-only filled container.

Transport Refrigeration

In some cases it is advantageous to deliver partially frozen beverage containers to their intended destinations already frozen. In these cases it is necessary to have a dual-temperature refrigeration device installed on board a truck or other vehicle (airplane, ship, etc.). Having the beverage containers delivered already partially frozen provides two advantages: 1.) it eliminates the normal waiting time to accomplish the freezing, since they are already frozen, and 2.) if the beverages are being delivered for immediate sale or consumption, it eliminates the need for a separate dual-temperature refrigeration device at the destination.

Freezer-Only

Another type of dual-temperature refrigerating device is a stand-alone device having only one compartment. This configuration uses the ambient environment surrounding the outside of the device as the beverage compartment, since in most cases the ambient environment will be above freezing. Obviously such an arrangement will not work outdoors in a cold climate, where outside temperatures fall below freezing. Such a configuration is shown in FIG. 6.

Figure 6:
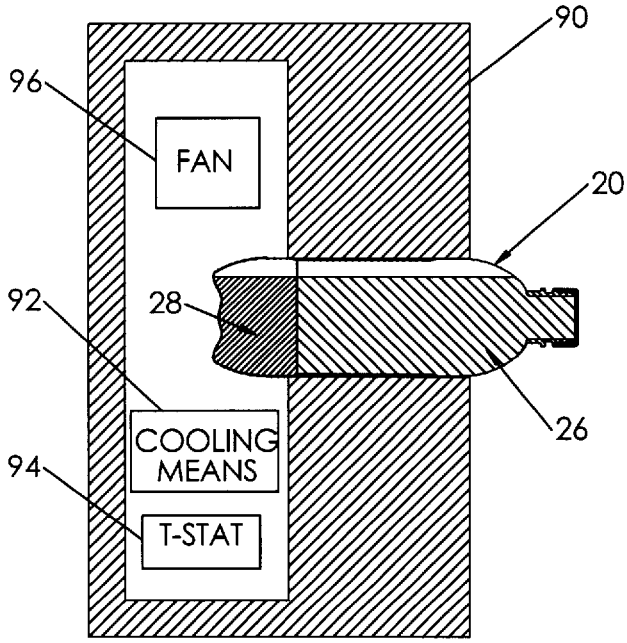
FIG. 6 is a vertical cross-section a version of a dual-temperature refrigerating device consisting of a freezer that houses beverage containers so that the containers reside partially within the freezer and a partially outside the freezer. The beverage containers are exposed to both the cold environment within the freezer and the warm ambient environment surrounding the freezer.

FIG. 6 shows an insulated freezer 90 having a cooling means 92, a thermostatic temperature control 94 and a fan 96, and housing a container 20. In this arrangement, cooling means 92 cools the inside of freezer 90 to a temperature below freezing, within which sits the ice compartment 28 of container 20. Thermostat 94 controls cooling means 92 so as to maintain the desired temperature within freezer 90 and fan 96 insures that the temperature is uniform within freezer 90. The beverage compartment 26 of container 20 is kept above freezing by virtue of its exposure to the temperatures in the ambient environment surrounding freezer 90. Additional controls can be used to adjust the temperature within freezer 90 to compensate for variations in the ambient temperature.

Freezing Method

In each of the above described dual-temperature refrigerating devices, a beverage container is frozen and then kept in that frozen state using the same method, described below. As with the above described embodiments, it will be understood that the description and the appended claims contemplate devices and methods including "one or more than one" container 20. Referring to the device as shown in FIG. 2, that method is to first place the beverage container 20 inside the dual-temperature refrigerating enclosure 10 such that the ice compartment 28 of beverage container 20 is inside the cold compartment 16 of enclosure 10, and the beverage compartment 26 of container 20 is inside the warm compartment 18 of enclosure 10. The cold temperatures within the cold compartment 16 of enclosure 10 cause the beverage 30 in the ice compartment 28 to freeze and stay frozen, while the beverage 30 in the beverage compartment 26 stays unfrozen.

To increase the rate at which the beverage 30 in the ice compartment 28 is initially frozen, additional temperature controls can be used to drop the freezer and refrigerator compartments to a much colder than normal temperature for a short period of time. For example, in a test freezer it was found that a temperature of around 40° F. in the refrigerator compartment and a temperature of about 15° F. in the freezer compartment would maintain indefinitely the desired amount of ice in a container 20. Temperatures substantially higher or lower than those (in one or both compartments) would cause too much or too little ice in the container 20, respectively. However, this optimal ice-maintenance temperature also caused the initial freezing of the beverage to take 12 hours or more. Allowing the temperature in the refrigerator and freezer compartments to temporarily drop to 34° F. and 10° F. (respectively) allowed freezing to occur in less than 8 hours. After the freezing is accomplished, it is necessary to bring the temperatures back to the optimal ice-maintenance temperatures to prevent over-freezing.

Such a temporary cool-down cycle as just described can be implemented so that it occurs once each time an unfrozen container 20 is inserted into the refrigerating device. This allows newly inserted containers to be frozen more quickly than they otherwise would. It is also possible to initiate this "cool-down" cycle on a regular basis. For example, temporarily lowering the temperature in one or both of the compartments every 12 hours (or on some other regular interval) can be done to insure that all newly inserted containers are frozen more quickly. Both of these approaches will more quickly freeze the beverage containers while also maintaining the desired quantity of ice in the containers. Any above described embodiment may include suitable timers or other controllers so that a "cool-down" cycle can be performed at desired events (such as the insertion of a container or at desired intervals).

It should be noted that the temperatures listed above that provided the desired freezing behavior in the inventor's test apparatus and may not be valid in other situations. The optimal temperatures for any given freezer can vary depending on:

1.) the beverage 30 used (soft drinks freeze differently than water, for example)
2.) the size and shape of the container 20
3.) any special design features of container 20 that promote or inhibit freezing of its contents (e.g., internal barriers or insulation which affect heat transfer within container 20)
4.) the size and shape of the ice compartment 28 of the container 20 and/or the amount of container 20 exposed to the cold compartment 16
5.) the size and shape of the beverage compartment 26 of the container 20 and/or the amount of container 20 exposed to the warm compartment 18
6.) the velocity of air passing over the exterior of either or both the ice compartment 28 or the beverage compartment 26
7.) the amount of ice that is desired to be frozen and maintained within container 20

In addition, there is not just one set of temperatures (e.g., one temperature for the cold compartment 16 and one temperature for the warm compartment 18) that provide the desired freezing in a given situation. Rather, there is a range of temperatures for the cold compartment 16 and a corresponding range of temperatures for the warm compartment 18 that will work. For example, in the inventor's tests a cold temperature of 15° F. was found to work when the warm compartment 18 temperature was 40° F. If the temperature in the cold compartment 16 is lowered a few degrees and the temperature in the warm compartment 18 is raised a few degrees, the temperatures still work. However, lowering one temperature significantly without raising the other, or raising one temperature significantly without lowering the other results in undesired melting or freezing of the beverage in the container 20.

The optimal temperatures for a given freezer and a given set of beverage containers can be easily determined experimentally. It can be said that generally, however, that the desired freezing can usually be achieved with temperatures in the cold compartment 16 somewhere in the range of 0° F. to 30° F., and temperatures in the warm compartment 18 somewhere in the range of 34° F. and 60° F.

What I claim is:

1. A cooling device for a fluid container comprising:

a. a first zone that exposes a first portion of said fluid container to temperatures below 32 degrees Fahrenheit;

b. a second zone that exposes a second portion of said fluid container to temperatures above 32 degrees Fahrenheit, whereby a portion of the fluid within said fluid container is caused to freeze and another portion of said fluid is caused not to freeze.

2. The device of claim 1 further comprising said fluid container and wherein said fluid container contains an internal structure that affects the heat transfer within said fluid within said fluid containers.

3. The device of claim 1 further comprising a seal located between said first zone and said second zone and surrounding said container that prevents unwanted heat transfer between said first zone and said second zone.

4. The device of claim 1 further comprising a closure located between said first zone and said second zone to prevent unwanted heat transfer between said first zone and said second zone when said container is not present.

5. The device of claim 1 wherein said first zone is located within said second zone.

6. The device of claim 5 wherein said first zone is kept below 32 degrees Fahrenheit by a cooling means.

7. The device of claim 6 wherein said cooling means is a refrigeration system.

8. The device of claim 6 wherein said cooling means is thermostatically controlled.

9. The device of claim 5 wherein said first zone is removable from said second zone.

10. The device of claim 1 wherein said second zone is located within said first zone.

11. The device of claim 10 wherein said second zone is kept above 32 degrees Fahrenheit by a heat source.

12. The device of claim 11 wherein said heat source is thermostatically controlled.

13. The device of claim 11 wherein said heat source is an electrical resistance heater.

14. The device of claim 10 wherein said second zone is removable from said first zone.

15. The device of claim 1 wherein said first zone and said second zone are adjacent to one another.

16. The device of claim 1 wherein said first zone and said second zone exist within a fluid-container vending machine.

17. The device of claim 1 wherein said first zone and said second zone are installed on a vehicle.

18. The device of claim 1, wherein said fluid container is maintained in a horizontal orientation within said device.

19. The device of claim 1, further comprising means for cooling said container upon the satisfaction of pre-selected criteria at a rate that is faster than when said criteria is not satisfied.

20. The device of claim 1, wherein said container is maintained in a vertical orientation within said device.

21. The device of claim 1, further comprising means for cooling said container upon the satisfaction of pre-selected criteria at a rate that is faster than when said criteria is not satisfied.

22. A cooling device for at least one fluid container comprising:

a. an enclosure;

b. a zone within said enclosure that exposes said container to temperatures below 32 degrees Fahrenheit;

c. at least one opening in said enclosure in which said fluid container can be located, whereby said container is simultaneously exposed to said below-32-degree temperature zone and to a warmer temperature in an environment surrounding said cooling device, whereby a portion of said fluid within said container freezes and a portion of said fluid does not freeze.

23. A method for freezing a portion of the fluid within a fluid container including:

a. a fluid container containing a fluid;

b. a cooling device for said fluid container comprising:

i) a first zone that-exposes a first portion of said container to temperatures below 32 degrees Fahrenheit;

ii) a second zone that exposes a second portion of said container to temperatures above 32 degrees Fahrenheit;

c. placing said fluid container in said cooling device, whereby said first portion of said container is exposed to said above 32 degree temperatures and to said second portion of said container is exposed to said below 32 degree temperatures;

d. leaving said fluid container in said refrigeration device for a length of time sufficient to cause a portion of said fluid to freeze.

24. The method of claim 23 further comprising the steps of:

a. controlling the temperature in said first zone at a first temperature;

b. controlling the temperature in said second zone at a second temperature whereby the volume of fluid frozen within said fluid container is maintained at a constant amount.

* * * * *